US006068460A

United States Patent [19]

Haarstad et al.

[11] Patent Number: 6,068,460

[45] Date of Patent: May 30, 2000

[54] TWO SPEED GEROTOR MOTOR WITH PRESSURIZED RECIRCULATION

[75] Inventors: Donald M. Haarstad, Chaska; Karen J. Radford, Minneapolis; Dwight B. Stephenson, Burnsville, all of Minn.

[73] Assignee: Eaton Corporation, Cleveland, Ohio

[21] Appl. No.: 09/181,440

[22] Filed: Oct. 28, 1998

[51] Int. Cl.[7] ..... F01C 1/02

[52] U.S. Cl. ..... 418/61.3

[58] Field of Search ..... 418/61.3

[56] References Cited

U.S. PATENT DOCUMENTS

| | | | |
|---|---|---|---|
| 3,572,983 | 3/1971 | McDermott . | |
| 4,457,677 | 7/1984 | Todd | 418/61.3 |
| 4,480,971 | 11/1984 | Swedberg | 418/61.3 |
| 4,645,438 | 2/1987 | Dahlquist | 418/61.3 |
| 5,061,160 | 10/1991 | Kinder et al. | 418/61.3 |

FOREIGN PATENT DOCUMENTS

| | | | |
|---|---|---|---|
| 0412403 | 2/1991 | European Pat. Off. | 418/61.3 |
| 8401800 | 5/1984 | WIPO | 418/61.3 |

*Primary Examiner*—Thomas Denion
*Assistant Examiner*—Theresa Trieu
*Attorney, Agent, or Firm*—L. J. Kasper

[57] ABSTRACT

A two speed gerotor motor in which the rotary disk valve (47) and the balancing ring (67) cooperate with a control valve assembly (87) to define four different fluid zones arranged within a housing (21) in a generally concentric pattern to provide a relatively compact arrangement. Among the four fluid zones one (95) is always connected to an inlet (51) while another (101) is always connected to an outlet (53). The middle two zones (97, 99) communicate with each other in the high speed, low torque mode. Operatively associated with the control valve assembly (87) is a shuttle valve (103) such that high pressure is always communicated to the middle two zones, such that high pressure is always circulated within the gerotor gear set (17) in the high speed, low torque mode. The control valve (87) includes a spool valve (107) including dampening passages (123, 125, 127) which dampen or cushion the shifting of the spool valve between the high speed and low speed conditions.

9 Claims, 4 Drawing Sheets

TWO SPEED GEROTOR MOTOR WITH PRESSURIZED RECIRCULATION

BACKGROUND OF THE DISCLOSURE

The present invention relates to rotary fluid pressure devices of the type in which a gerotor gear set serves as the fluid displacement mechanism, and more particularly, to such devices which are provided with two speed capability.

Although the teachings of the present invention can be applied to devices having fluid displacement mechanisms other than gerotors, such as cam lobe type devices, the invention is especially adapted to gerotor devices and will be described in connection therewith.

Devices utilizing gerotor gear sets can be used in a variety of applications, one of the most common being to use the device as a low-speed, high-torque motor. One common application for low-speed, high-torque gerotor motors is vehicle propulsion, wherein the vehicle includes an engine driven pump which provides pressurized fluid to a pair of gerotor motors, with each motor being associated with one of the drive wheels. Those skilled in the art will be aware that many gerotor motors utilize a roller gerotor, especially on larger, higher torque motors of the type used in propel applications, and subsequent references hereinafter to "gerotors" will be understood to mean and include both conventional gerotors, as well as roller gerotors.

In recent years, there has been a desire on the part of the vehicle manufacturers to be able to provide both the low-speed, high-torque mode of operation, such as when the vehicle is at the work site, and also a high-speed, low-torque mode of operation, for when the vehicle is traveling between work sites. One possible solution has been to provide a gerotor motor having a two-speed capability.

Two speed gerotor motors are known from U.S. Pat. No. 4,480,971, assigned to the assignee of the present invention and incorporated herein by reference. The device of the cited patent has been in widespread commercial use and has performed in a generally satisfactory manner. As is well known to those skilled in the art, a gerotor motor may be operated as a two speed device by providing valving which can effectively "recirculate" fluid between expanding and contracting fluid volume chambers of the gerotor gear set. In other words, if the inlet port communicates with all of the expanding chambers, and all of the contracting chambers communicate with the outlet port, the motor operates in the normal low-speed, high-torque mode. If some of the fluid from the contracting chambers is recirculated back to some of the expanding chambers, the result will be operation in a high-speed, low-torque mode.

However, one of the inherent shortcomings of the design of the cited patent is that the valving has been of the "three zone" type, i.e., there is one zone communicating with the inlet, one zone communicating with the outlet, and one changeover zone. As a result of this three zone architecture, when the motor operates in the clockwise direction, for example, high pressure fluid is recirculated, but when the motor operates in the counterclockwise direction, low pressure fluid is recirculated. As is also well known to those skilled in the art, recirculation of low pressure fluid can result in cavitation within the valving and the gerotor gear set, and such cavitation can eventually lead to failure of the motor.

Another problem with the device of the cited patent is that the configuration of the balancing ring was such that several seals were required at various locations on several outside diameters of the balancing ring, sealing between the ring and adjacent inside diameters of the valve housing of the motor. This type of multiple-diameter sealing added to the difficulty and expense of the machining and assembly of the motor.

There has been a device commercially available in which the valving provided four zones, such that the two middle zones are connected to the recirculating volume chambers in such a way that high pressure is always recirculated, for either direction of operation. The described device, commercialized by Sumitomo Eaton Hydraulics Co., Ltd., a licensee of the assignee of the present invention, had the valving located "forward" of the gerotor, i.e., between the gerotor gear set and the output shaft. The valving configuration is such that the overall package is quite large, the associated control valving, to shift between low-speed and high-speed, is quite complicated, and the resulting motor would not be commercially acceptable for many applications.

One additional problem associated with two speed gerotor motors is that the shifting between low-speed, high-torque and high-speed, low-torque is typically somewhat abrupt or harsh, resulting in a sudden acceleration or deceleration of the vehicle. Naturally, the vehicle operators would prefer that the shifting between the two modes of operation be smooth, rather than too quick or too harsh, as shifts which are too quick can result in tipping of the vehicle or losing control of a load, such as a load on the tines of a forklift truck.

A final problem associated with vehicles equipped with two speed gerotor motors is that certain vehicles are equipped with a pair of motors to drive a pair of propel wheels in a parallel circuit. On such a vehicle, it has been difficult to get the motors to shift at the same time. However, if there is a delay between the shifting of one motor and the shifting of the other motor, the result will be an inadvertent turning of the vehicle during the time one motor is operating at high-speed and the other motor is operating at low-speed.

BRIEF SUMMARY OF THE INVENTION

Accordingly, it is an object of the present invention to provide a two speed gerotor motor which overcomes the problems of the prior art two speed motors.

It is a more specific object of the present invention to provide an improved two speed motor in which relatively high pressure fluid is recirculated in either direction of operation.

It is an even more specific object of the present invention to provide an improved two speed gerotor motor which achieves the above-stated objects by means of a novel four zone valving arrangement wherein the motor valving and the shift valving arrangement is still reasonably compact.

It is another object of the present invention to provide an improved two speed gerotor motor which reduces the number of seals between the outside diameter of the balancing ring and the valve housing of the motor, thus simplifying the assembly of the motor.

It is an additional object of the present invention to provide an improved two speed gerotor motor in which the shifting between low-speed, high-torque and high-speed, low-torque is cushioned to reduce the likelihood of the shift occurring too quickly.

It is a final object of the present invention to provide an improved two speed gerotor motor wherein, on vehicles utilizing a pair of the motors, the ability of the motors to shift at nearly the same exact time is substantially improved.

The above and other objects of the invention are accomplished by the provision of an improved rotary fluid pressure device of a type including housing means defining a fluid inlet means and a fluid outlet means. A fluid energy translating displacement means defines expanding and contracting fluid volume chambers, and stationary valve means defining stationary fluid passages in fluid communication with the expanding and contracting fluid volume chambers. A rotary disk valve member is disposed rearwardly of the stationary valve means and defines inlet and outlet valve passage means providing fluid communication between the fluid inlet and outlet means, respectively, and the stationary fluid passages, in response to rotation of the disk valve member. A generally annular balancing ring member is in engagement with a rear surface of the disk valve member and is adapted to maintain the disk valve member in sealing engagement with the stationary valve member. The housing means encloses the disk valve member and the balancing ring member and defines control fluid passage means. The disk valve member and the balancing ring member cooperate to define motor valve passage means operable to provide fluid communication between the control fluid passage means defined by the housing and the inlet and outlet valve passage means defined by the rotary disk valve member. The device includes control valve means selectively operable between a first low speed, high torque condition and a second high speed, low torque condition.

The improved fluid pressure device is characterized by the motor valve passage means comprising first, second, third, and fourth motor valve passages. The control valve means defines first, second, third, and fourth control valve passages, in fluid communication, respectively, with the first, second, third, and fourth motor valve passages.

When the control valve means is in the high speed, low torque condition, the first control valve passage and the first motor valve passage provides fluid communication from the fluid inlet means to a plurality of the expanding fluid volume chambers. The second control valve passage and the second motor valve passage are in fluid communication with the remainder of the expanding fluid volume chambers. The fourth control valve passage and the fourth motor valve passage provide fluid communication from a plurality of the contracting fluid volume chambers to the fluid outlet means. The third control valve passage and the third motor valve passage are in fluid communication with the remainder of the contracting fluid volume chambers, and the control valve means provides fluid communication between the second and third control valve passages.

DETAILED DESCRIPTION OF THE PREFERRED EMBODIMENT

Figure 1:
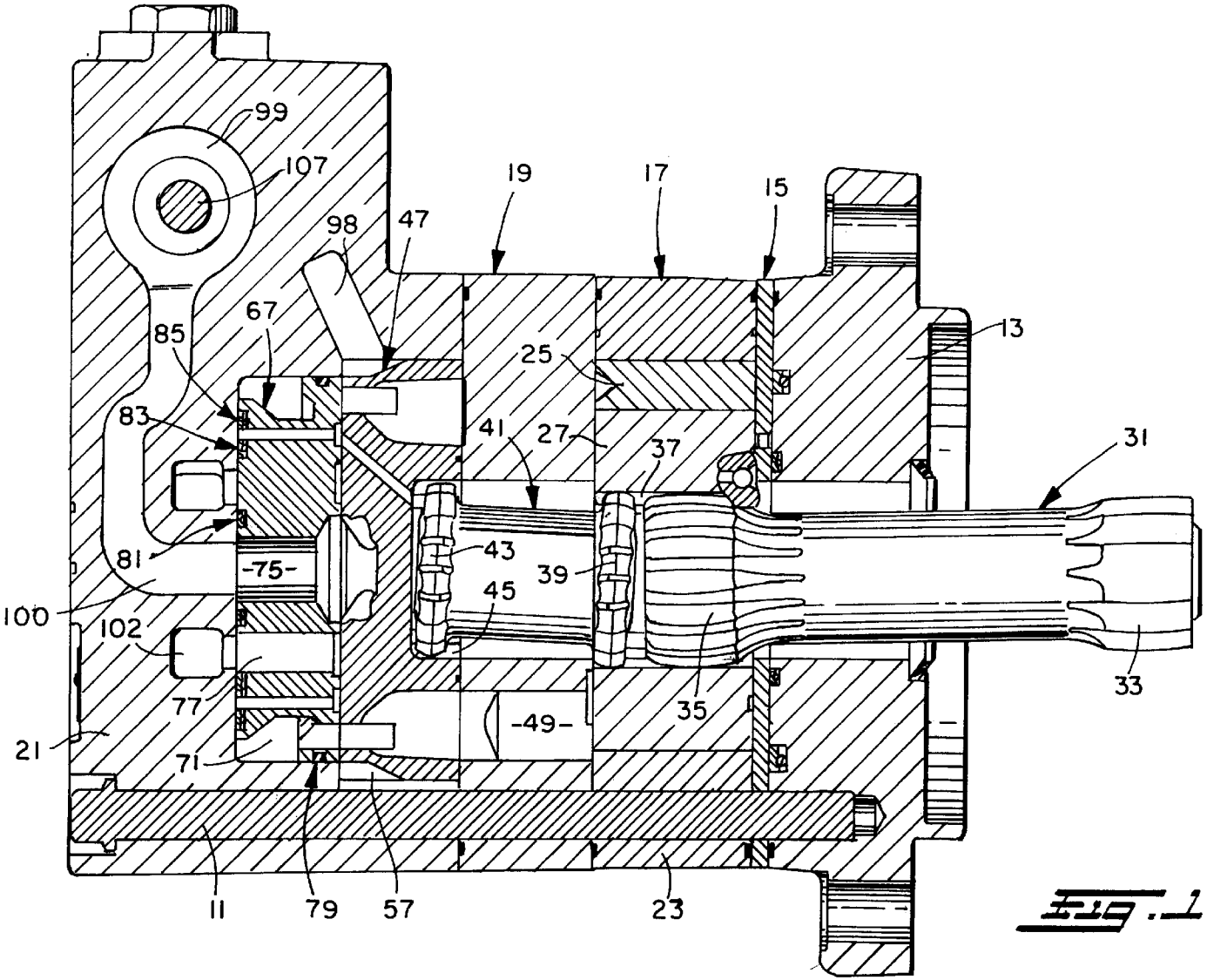
FIG. 1 is an axial cross-section of a two speed gerotor motor utilizing the valving arrangement of the present invention.

Referring now to the drawings, which are not intended to limit the invention, FIG. 1 illustrates an axial cross-section of a gerotor motor, of the type to which the present invention may be applied, and which is illustrated and described in greater detail in U.S. Pat. No. 3,572,983, assigned to the assignee of the present invention and incorporated herein by reference. More specifically, the gerotor motor shown in FIG. 1 is of the rotary disk valve, two speed type, illustrated and described in greater detail in above-incorporated U.S. Pat. No. 4,480,971. It should be understood that the term "motor" when applied to devices of the type shown herein is also intended to encompass the use of such devices as pumps.

The gerotor motor shown in FIG. 1 comprises a plurality of sections secured together, such as by a plurality of bolts 11 (only one of which is shown in FIG. 1). The motor includes a forward flange member 13, a wear plate 15, a gerotor displacement mechanism 17, a port plate 19, and a valve housing portion 21.

The gerotor displacement mechanism 17 is well known in the art and will be described only briefly herein. In the subject embodiment, the mechanism 17 comprises a roller gerotor gear set comprising an internally toothed ring 23 defining a plurality of generally semi-cylindrical openings. Rotatably disposed in each of the openings is a cylindrical roller member 25, as is now well known in the art. Eccentrically disposed within the ring 23 is an externally toothed rotor (star) 27, typically having one less external tooth than the number of roller members 25, thus permitting the star 27 to orbit and rotate relative to the ring 23. This relative orbital and rotational movement between the ring 23 and the star 27 defines a plurality of expanding volume chambers 29E (see FIG. 6) and a plurality of contracting volume chambers 29C.

Referring still primarily to FIG. 1, the motor includes a main drive shaft 31 (also referred to as a "dogbone"), including a set of crowned, external splines 33 formed about the forward end of the shaft 31, and a set of crowned, external splines 35 disposed about the rearward end of the shaft 31. The star 27 defines a set of straight internal splines 37, having the crowned splines 35 in engagement therewith, such that the orbital and rotational movement of the star 27 is translated into pure rotational motion of an output device (not shown) which receives the crowned splines 33. In the subject embodiment, because the star 27 includes eight external teeth, eight orbits of the star 27 results in one complete rotation thereof, and one complete rotation of the output device receiving the crowned splines 33.

Also in engagement with the internal splines 37 is a set of external splines 39 formed about one end of a valve drive shaft 41, which has, at its rearward end, another set of external splines 43 in engagement with a set of internal splines 45 formed about the inner periphery of a rotary disk valve member 47. The valve member 47 is rotatably disposed within the valve housing 21, and the valve drive shaft 41 is splined to both the star 27 and the valve member 47, in order to maintain proper valve timing, as is generally well known in the art.

The port plate 19 defines a plurality of fluid passages 49 each of which is disposed to be in continuous fluid communication with an adjacent fluid volume chamber 29E or 29C. As is well known to those skilled in the art, as the star 27 orbits and rotates, and the valve member 47 rotates, each of the fluid passages 49 will alternately communicate pressurized fluid to a volume chamber as it expands (29E), then communicate exhaust (return) fluid away from that same chamber as it contracts (29C).

Figure 5:
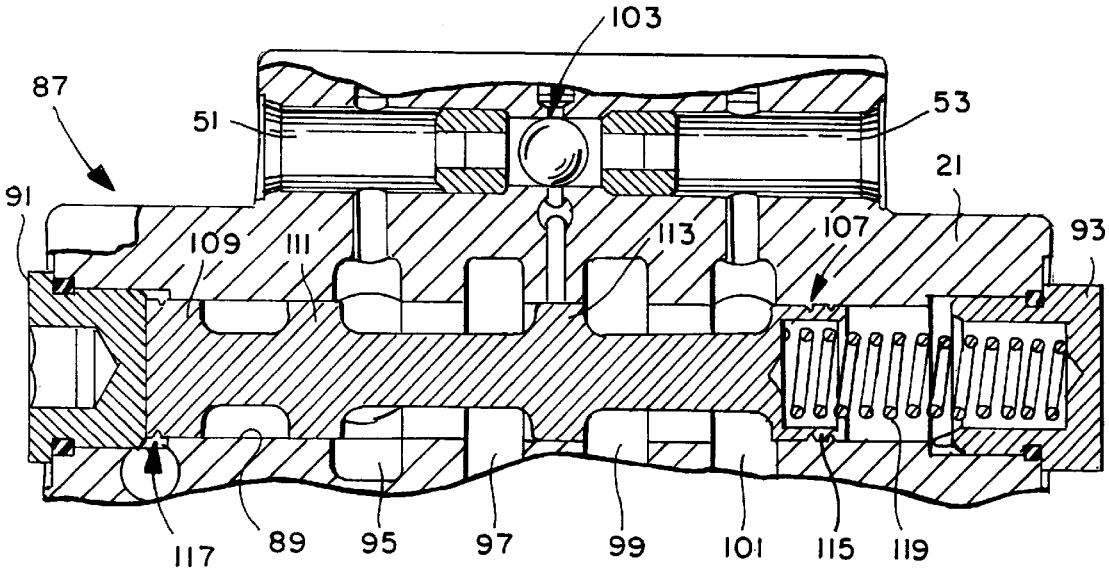
FIG. 5 is a fragmentary transverse cross-section, showing the shifting control valve of the present invention.
Figure 6:
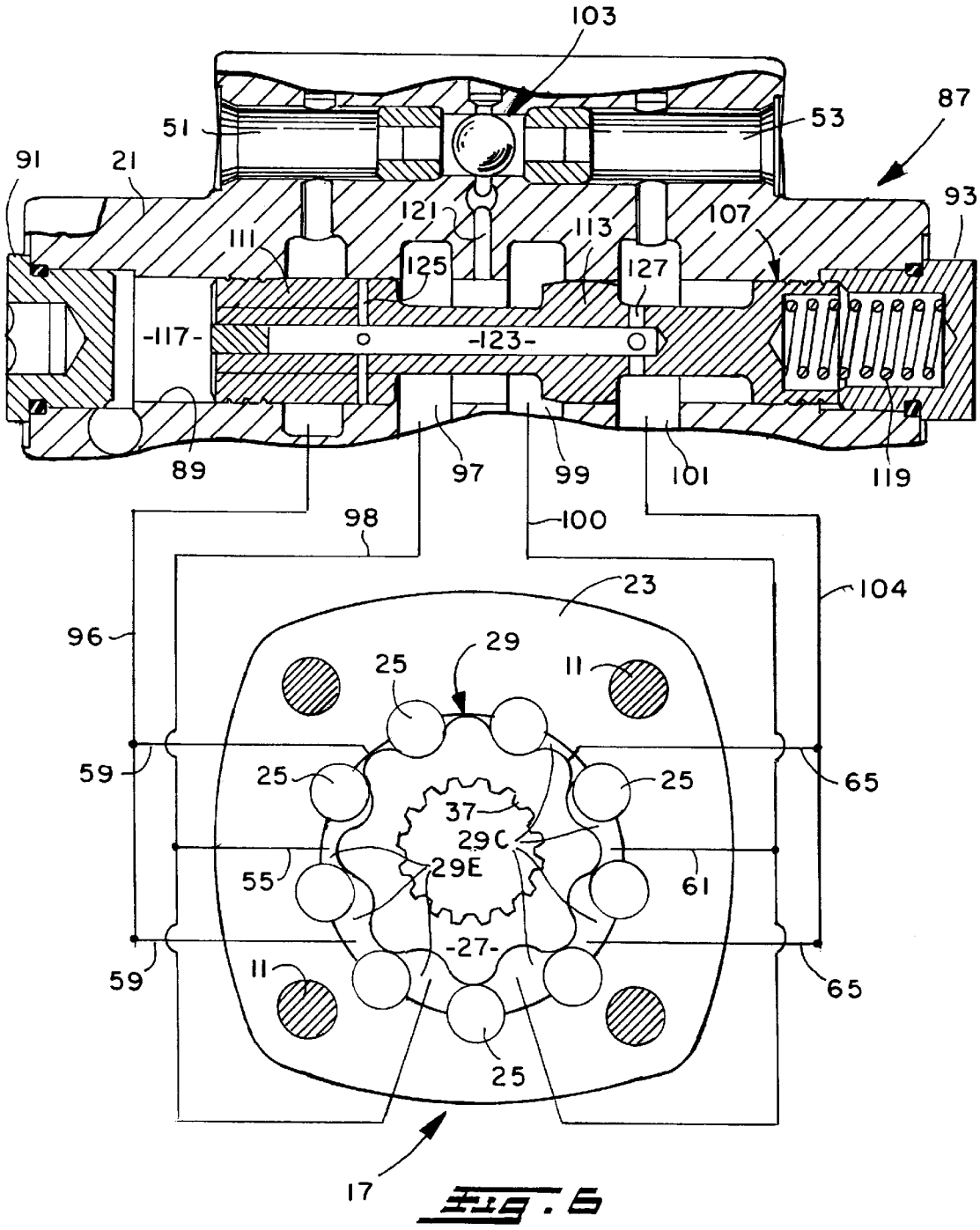
FIG. 6 is a somewhat schematic view illustrating the operation of the present invention in its high speed, low torque mode, and also illustrating an alternative embodiment of the shifting control valve.

The valve housing portion 21 includes a fluid inlet port 51 and a fluid outlet port 53, the ports 51 and 53 being shown in both FIGS. 5 and 6. As is well known to those skilled in the art, if the inlet and outlet ports 51 and 53 are reversed, the direction of rotation of the drive shaft 31 will be reversed.

Figure 2:
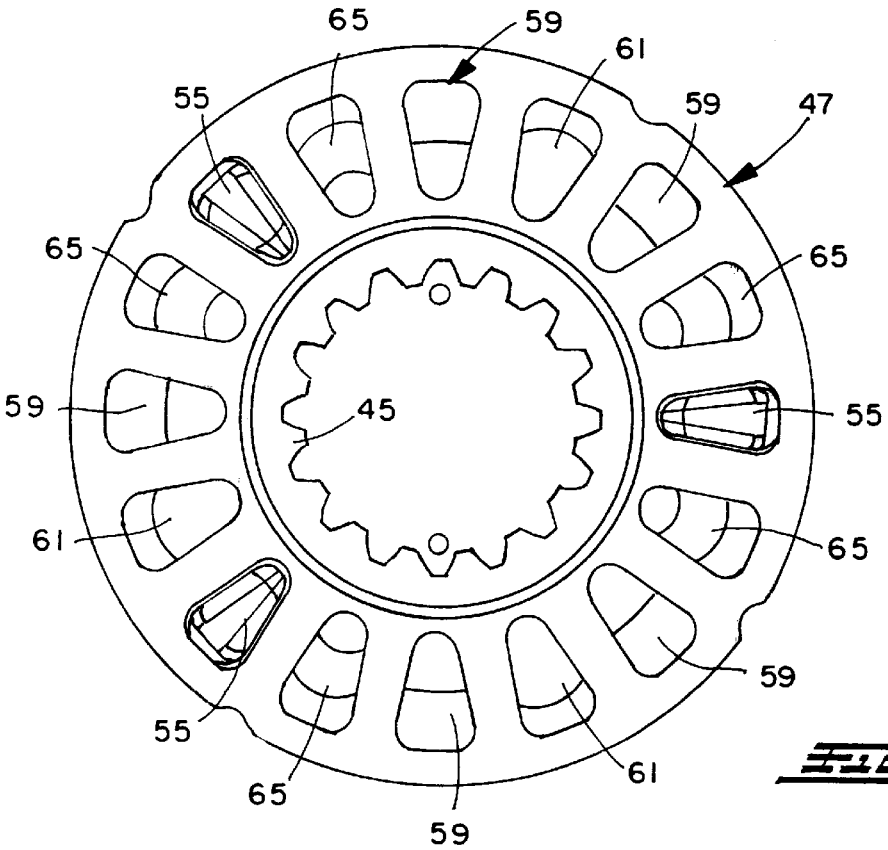
FIG. 2 is a front plan view of the rotary disk valve shown in FIG. 1.
Figure 3:
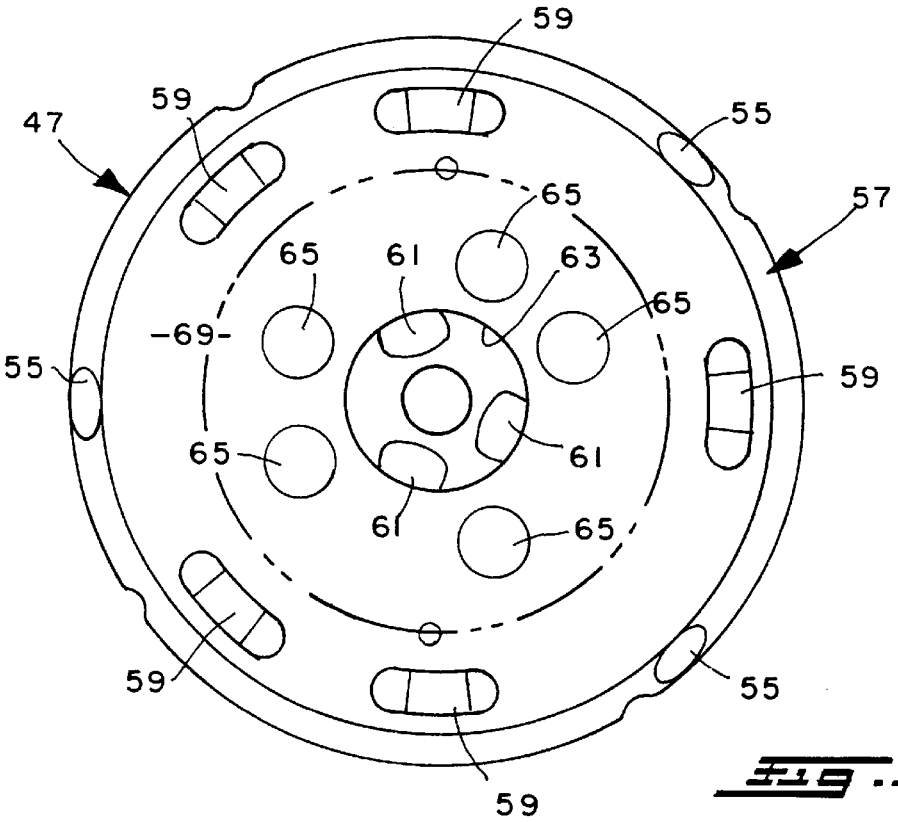
FIG. 3 is a rear plan view of the rotary disk valve shown in FIG. 1, and on about the same scale as FIG. 2.

The valve member 47 defines a plurality of valve passages 55 (see FIGS. 2, 3 and 6) in continuous fluid communication with an annular fluid chamber 57 defined by the valve member 47. In the subject embodiment, there are three of the valve passages 55. The valve member 47 also defines a plurality of valve passages 59, and as is shown in FIGS. 2 and 3, there are five of the passages 59. The valve member 47 also defines a plurality of valve passages 61, each of which emanates from an annular chamber 63 defined by the valve member 47, on the rearward side thereof. As may be seen in FIGS. 2 and 3, there are three of the valve passages 61. Finally, the valve member 47 defines a plurality of valve passages 65, and as may be seen in FIGS. 2 and 3, there are five of the passages 65. Thus, and by way of example only, there are eight external teeth on the star 27 (and therefore, nine volume chambers 29 (the "changeover" chamber), 29E, and 29C) and as a result, the number of valve passages 55 and 59 totals eight, while the number of valve passages 61 and 65 also totals eight.

Disposed adjacent the disk valve member 47 is a balancing ring 67 which is disposed in a generally cylindrical chamber defined by the valve housing 21, adjacent a rearward surface 69 of the valve member 47, and in engagement therewith. As is well known to those skilled in the art, the balancing ring 67 is typically fixed relative to the valve housing 21, such that it does not rotate, even as the disk valve member 47 rotates.

Figure 4:
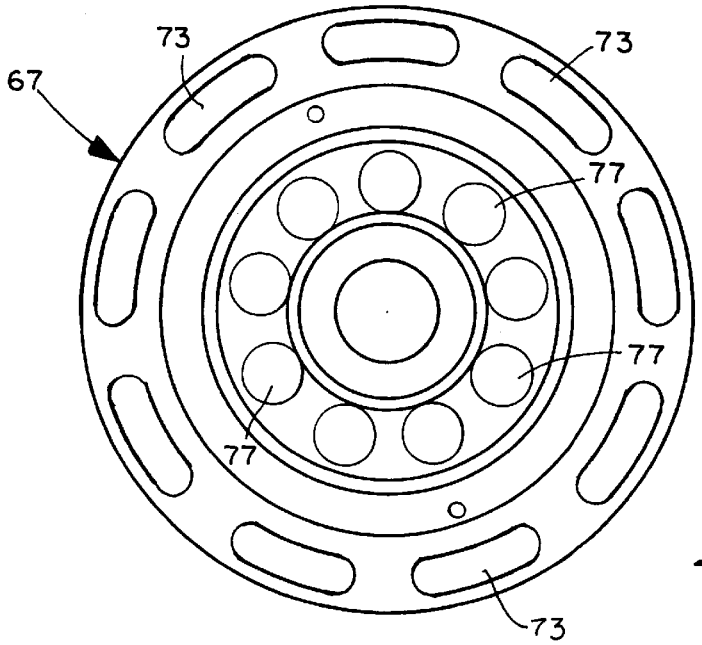
FIG. 4 is a front plan view of the balancing ring shown in FIG. 1

As may best be seen in FIG. 1, the balancing ring 67 defines an annular outer chamber 71 from which extend a plurality of axial passages 73, and as shown in FIG. 4, there are nine of the passages 73. The balancing ring 67 also defines a central open chamber 75 (see FIG. 1), and a plurality of axial passages 77, and as may be seen in FIG. 4, there are nine of the passages 77. Thus, the axial passages 73 in the balancing ring 67 communicate with the valve passages 59 in the rotary disk valve member 47. At the same time, the axial passages 77 in the balancing ring 67 communicate with the valve passages 65 in the disk valve 47. Finally, the central chamber 75 of the balancing ring 67 communicates with the valve passages 61 of the disk valve 47. As may best be seen by comparing FIG. 3 (the rearward surface of the disk valve 47) with FIG. 4 (the forward surface of the balancing ring 67), the communication of each passage in the disk valve with the corresponding passages in the balancing ring is continuous, as the disk valve 47 rotates relative to the balancing ring 67.

Referring now primarily to FIG. 1, it is one important aspect of the present invention that, although the balancing ring 67 defines the annular chamber 71, a central chamber 75, and an array of axial passages 77 disposed radially therebetween, there is only one "outside diameter" of the balancing ring 67 which requires sealing, which is accomplished by an O-ring seal 79. All other sealing, to separate the various chambers and passages may be accomplished simply by means of a plurality of face seals 81, 83 and 85, each of which is received within annular grooves defined in a rearward face of the balancing ring 67.

Referring now primarily to FIGS. 1 and 5, there will now be a description of a control valve assembly, generally designated 87, by which the motor may be shifted between the low speed, high torque and high speed, low torque modes of operation. The valve housing 21 defines a transverse bore 89 sealed at its opposite ends by fittings 91 and 93. The bore 89 defines a plurality of annular chambers 95, 97, 99, and 101. In accordance with one important aspect of the invention, the annular chamber 95 is in open fluid communication with the inlet port 51, while the annular chamber 101 is in open fluid communication with the outlet port 53. Disposed between the ports 51 and 53 is a shuttle valve assembly, generally designated 103, the structural details of which form no part of the present invention. The function of the shuttle valve assembly 103 will be described subsequently.

Disposed within the bore 89 is a spool valve, generally designated 107, which includes a plurality of lands 109, 111, 113 and 115. The land 109 cooperates with the fitting 91 and the bore 89 to define a pilot chamber 117 (best shown in FIG. 6) which, as is well known to those skilled in the art, is adapted to receive a pilot pressure signal to move the spool valve 107 between its two operating positions, to be described subsequently. The land 115 cooperates with the fitting 93 to define a spring chamber in which is disposed a biasing spring 119, adapted to bias the spool valve 107 toward its normal, low speed, high torque position as shown in FIG. 5.

Referring still primarily to FIGS. 1 and 5, the annular chamber 95 communicates with the annular outer chamber 71 of the balancing ring 67 by means of a cored passage 96 (see FIG. 6). The annular chamber 97 is in direct communication with the annular fluid chamber 57 defined by the disk valve 47, by means of a cord passage 98, part of which is shown in FIG. 1. The annular chamber 99 is in fluid communication with the central open chamber 75 of the balancing ring 67 by means of a cored passage 100, all of which is shown in FIG. 1. Finally, the annular chamber 101 is in fluid communication with the axial passages 77 in the balancing ring 67 by means of an annular cored chamber 102 (see FIG. 1), and in turn, by means of a cored passage 104, shown only in FIG. 6.

OPERATION

When the vehicle operator wishes to operate the motor in the normal, low speed, high torque mode, an appropriate pilot signal is communicated to the pilot chamber 117 to permit the spool valve 107 to be biased to the position shown in FIG. 5. In that position, the land 113 separates the annular chambers 95 and 97 from the annular chambers 99 and 101 as shown in FIG. 5. With pressurized fluid ("high pressure") being communicated to the inlet port 51, there will be high pressure in both of the annular chambers 95 and 97, and therefore, there will be high pressure in the cored passages 96 and 98, and in the annular chamber 71 and axial passages 73 and the valve passages 59 (all of which communicate with the annular chamber 95), as well as in the annular chamber 57 and valve passages 55 (all of which communicate with the annular chamber 97). As is well known to those skilled in the art, the valve passages 55 and 59, containing high pressure, are in commutating fluid communication with the fluid passages 49 in the port plate 19 which are instantaneously in communication with the expanding fluid volume chambers 29E.

At the same time, each of the contracting fluid volume chambers 29C is instantaneously in communication with fluid passages 49 in the port plate 19 which are in commutating fluid communication with valve passages 61 and 65 in the disk valve 47. This exhaust (low pressure) fluid in the valve passages 61 and 65 is communicated to the outlet port 53. Low pressure fluid in the valve passages 61 flows to the central chamber 75 in the balancing ring 67, and from there through the cored passage 100 to the annular chamber 99 which, as may best be seen in FIG. 5, is now in open communication with the annular chamber 101, and therefore, with the outlet port 53. Low pressure fluid in the valve passages 65 is communicated to the axial passages 77 in the balancing ring 67, and from there through the cored passages 102 and 104 to the annular chamber 101, and then to the outlet port 53.

Therefore, with the spool valve 107 in the position shown in FIG. 5, the motor operates in the normal low speed, high torque mode in which high pressure is communicated to all of the expanding volume chambers 29E and low pressure is exhausted from all of the contracting volume chambers 29C.

Referring now to FIG. 6, in conjunction with other drawing figures, another important aspect of the present invention will be described. It should be noted that FIG. 6 shows an alternative embodiment of the spool valve 107, as will be described subsequently. When the vehicle operator wishes to operate the motor in the high speed, low torque mode, such as when it is desirable to transport the vehicle between work sites at a relatively high speed, the operator communicates an appropriate pilot signal to the pilot chamber 117 to bias the spool valve 107 to the position shown in FIG. 6. As may be seen in FIG. 6, the land 111 now separates the annular chambers 95 and 97, while the land 113 separates the annular chambers 99 and 101. As a result, high pressure is communicated from the inlet port 51 (for operation in the "forward" direction) through the annular chamber 95 to the five valve passages 59, in the manner described previously. At the same time, high pressure fluid flows from the inlet port 51 through the shuttle valve assembly 103, and through a passage 121 into the bore 89, then into the annular chamber 97, which then flows to the three valve passages 55 in the manner described previously. With the spool valve 107 in the position shown in FIG. 6, high pressure fluid also flows from the inlet port 51 through the passage 121 and into the annular chamber 99, and from there it flows to the three valve passages 61 as described previously.

However, in accordance with an important aspect of the invention, the valve passage 61 are in commutating communication with contracting volume chambers 29E, such that, at any given instant in time, there are the same number of expanding volume chambers 29E in communication with the annular chamber 97 as there are contracting volume chambers 29C in communication with the annular chamber 99. Thus, instantaneously, the fluid which is anywhere between the annular chamber 97, and its expanding chambers 29E, and the annular chamber 99 and its contracting chambers 29C is merely "recirculating" as that concept is generally well understood to those skilled in the art of two-speed gerotor motors. However, in accordance with the present invention, high pressure fluid is being recirculated.

If now it is desired by the vehicle operator to "reverse" the direction of operation of the motor, the port 53 receives high pressure fluid, and the port 51 is communicated with a system reservoir. With the spool valve 107 again in the position shown in FIG. 5, high pressure is communicated to the annular chambers 99 and 101, which in turn is communicated with all of the expanding volume chambers 29E, while all of the contracting volume chambers 29C are in communication with the annular chambers 95 and 97, as should be readily apparent to those skilled in the art. Thus, the motor again operates in the low speed, high torque mode.

When the vehicle operator wishes to operate in the high speed, low torque mode, but still in the "reverse" direction, the appropriate pilot signal is again communicated to the pilot chamber 117 to move the spool valve 107 to the position shown in FIG. 6. In this position, high pressure is communicated to the annular chamber 101 and from there to the five valve passages 65 which are in commutating fluid communication with certain of the expanding volume chambers 29E. At the same time, high pressure fluid is communicated from the port 53 through the shuttle valve assembly 103 into both the annular chamber 99 and the annular chamber 97, which are again in open communication with each other, such that in the same manner as described previously in connection with "forward" operation of the motor, high pressure fluid merely recirculates between the annular chamber 99, its expanding volume chambers 29E, and the annular chamber 97, and its contracting volume chambers 29C. Finally, some of the contracting volume chambers 29C are in fluid communication with the annular chamber 95, and through the port 51 to the system reservoir. Thus, in accordance with the present invention, for either direction of operation of the motor, high pressure fluid is recirculated during operation in the high speed, low torque mode of operation, thus overcoming the problems associated with recirculating low pressure fluid in one direction of operation and cavitating the motor.

Referring still primarily to FIG. 6, another aspect of the invention will be described. In FIG. 6, the spool valve 107 defines a central, axial bore 123, preferably plugged at its left end, with a pair of diametral passages 125 and 127 intersecting the bore 123. With the spool valve 107 in its high-speed, low torque position shown in FIG. 6, flow through the passage 125 is blocked by the bore 89, while the passage 127 is in open communication with the outlet port 53. As the spool valve 107 begins to shift from the position shown toward the low-speed, high torque position represented in FIG. 5, before the land 113 reaches the position in which it separates annular chambers 97 and 99, the passage 125 will be in open communication with the annular chamber 95, and therefore, in communication with high pressure. At the same time, the passage 127 is still in open communication with the outlet port 53 through the annular chamber 101, such that high pressure is somewhat relieved from the chamber 95, through the passage 125, the bore 123, the passage 127, and the chamber 101.

As a result, instead of an abrupt shift from high-speed into low-speed (which would be like suddenly, partially applying the vehicle brakes), the shift is dampened or smoothed by the limited communication of high pressure through the spool valve 107 to the outlet port 53. When the spool valve 107 is again shifted all the way to the left, to the position shown in FIG. 5, flow through the passage 125 is again blocked by the bore 89, and full pressure can again build in the inlet port 51, thus permitting normal low-speed, high-torque operation. It may be seen in FIG. 6 that when shifting the spool valve 107 from the low-speed position to the high-speed position, the dampening of the shifting will occur in the same manner as just described.

As was mentioned in the BACKGROUND OF THE DISCLOSURE, it is common to have two motors in a parallel circuit, with each motor driving a separate drive (propel) wheel. On a vehicle of the type described, it is very undesirable to have a time lag or delay between the shifting of one motor and the shifting of the other motor, because during such a time lag, the vehicle will turn in the direction of the motor which is still in low-speed. In order to overcome this problem, which is caused mainly by friction in connection with the movement of the spool valve 107, the force of the spring 119 is selected such any such friction is overcome by the spring 119. However, a correspondingly greater pressure will be needed in the pilot chamber 117 in order to shift the spool valve 107 toward the FIG. 6 position. It is believed to be within the ability of those skilled in the valving art to select appropriate springs and pilot pressures to accomplish the stated objective, based upon a reading and understanding of this specification.

Thus, the present invention provides an improved two-speed gerotor motor which recirculates high pressure in either direction of operation, and does so by means of motor valving 47 and shifting valving 107 which are located rearwardly of the gerotor gear set, and are reasonably compact. Furthermore, the balancing ring 67 requires outside diameter sealing at only one location, which is somewhat related to the fact that the various cored passages (representing the four zones) are not arranged axially, but instead are generally concentric. Finally, the operation of the shifting valving 107 is dampened so that shifting between high-speed and low-speed is smoother, and the shifting valving is improved such that, if a pair of the motors is operated in parallel, the shifting of the two motors will occur at nearly the same time.

The invention has been described in great detail in the foregoing specification, and it is believed that various alterations and modifications of the invention will become apparent to those skilled in the art from a reading and understanding of the specification. It is intended that all such alterations and modifications are included in the invention, insofar as they come within the scope of the appended claims.

What is claimed is:

1. A rotary fluid pressure device of the type including housing means defining a fluid inlet means and a fluid outlet means; fluid energy-translating displacement means defining expanding and contracting fluid volume chambers, stationary valve means defining stationary fluid passages in fluid communication with said expanding and contracting fluid volume chambers, a rotary disc valve member disposed rearwardly of said stationary valve means, and defining inlet and outlet valve passage means providing fluid communication between said fluid inlet and outlet means, respectively, and said stationary fluid passages, in response to rotation of said disc valve member; and a generally annular balancing ring member in engagement with a rear surface of said disc valve member, and adapted to maintain said disc valve member in sealing engagement with said stationary valve means; said housing means enclosing said disc valve member and said balancing ring member, and defining control fluid passage means; said disc valve member and said balancing ring member cooperating to define motor valve passage means operable to provide fluid communication between said control fluid passage means defined by said housing means and said inlet and outlet valve passage means defined by said rotary disc valve member; and control valve means selectively operable between a first low speed, high torque condition and a second high speed, low torque condition; characterized by:

(a) said motor valve passage means comprising first, second, third, and fourth motor valve passages; and (b) said control valve means defining first, second, third, and fourth control valve passages, in fluid communication, respectively, with said first, second, third, and fourth motor valve passages whereby;

(c) when said control valve means is in said high speed, low torque condition, said first control valve passage and said first motor valve passage provide fluid communication from said fluid inlet means to a plurality of said expanding fluid volume chambers, said second control valve passage and said second motor valve passage are in fluid communication with the remainder of said expanding fluid volume chambers, said fourth control valve passage and said fourth motor valve passage provide fluid communication from a plurality of said contracting fluid volume chambers to said fluid outlet means, and said third control valve passage and said third motor valve passage are in fluid communication with the remainder of said contracting fluid volume chambers, and said control valve means provides fluid communication between said second and third control valve passages.

2. A rotary fluid pressure device as claimed in claim 1 characterized by said control valve means being configured to provide fluid communication from said fluid inlet means to said second and third control valve passages when said control valve means is in said high speed, low torque condition.

3. A rotary fluid pressure device as claimed in claim 2 characterized by check valve means disposed to permit relatively unrestricted fluid communication from said first control valve passage to said second control valve passage.

4. A rotary fluid pressure device of the type including housing means defining a fluid inlet means and a fluid outlet means; fluid energy-translating displacement means defining expanding and contracting fluid volume chambers, stationary valve means defining stationary fluid passages in fluid communication with said expanding and contracting fluid volume chambers, a valve member disposed adjacent said stationary valve means, and defining inlet and outlet valve passage means providing fluid communication between said fluid inlet and outlet means, respectively, and said stationary fluid passages, in response to movement of said valve member; said housing means enclosing said valve member and defining control fluid passage means; said valve member defining motor valve passage means operable to provide fluid communication between said control fluid passage means defined by said housing means and said inlet and outlet valve passage means defined by said valve member; and control valve means selectively operable between a first low speed, high torque condition and a second high speed, low torque condition; characterized by:

(a) said motor valve passage means comprising first, second, third, and fourth motor valve passages;

(b) said control valve means defining first, second, third, and fourth control valve passages, in fluid communication, respectively, with said first, second, third, and fourth motor valve passages; and (c) shuttle valve means having an inlet in fluid communication with said fluid inlet means and an inlet in fluid communication with said fluid outlet means, and further having a shuttle outlet passage disposed to communicate fluid pressure from whichever one of said fluid inlet and outlet means is at higher pressure to said second and third control valve passages, whenever said control valve means is in said second high speed, low torque condition.

5. A rotary fluid pressure device as claimed in claim 4, characterized by said housing means defines a spool bore intersecting said first, second, third and fourth control valve passages, said second and third control valve passages being disposed axially between said first and fourth control valve passages, and said shuttle outlet passage communicating with said spool bore at a location disposed axially between said second and third control valve passages.

6. A two speed rotary fluid pressure device of the type including housing means defining a fluid inlet means and a fluid outlet means; fluid energy-translating displacement means defining expanding and contracting fluid volume chambers, stationary valve means defining stationary fluid passages in fluid communication with said expanding and contracting fluid volume chambers, a valve member disposed adjacent said stationary valve means, and defining inlet and outlet valve passage means providing fluid communication between said fluid inlet and outlet means, respectively, and said stationary fluid passages, in response to movement of said valve member; said housing means enclosing said valve member and defining control fluid passage means; said valve member defining motor valve passage means operable to provide fluid communication between said control fluid passage means defined by said housing means and said inlet and outlet valve passage means defined by said valve member; and control valve means selectively operable between a first low speed, high torque condition and a second high speed, low torque condition; characterized by:

(a) said motor valve passage means comprising first, second, third, and fourth motor valve passages;

(b) said control valve means defining first, second, third, and fourth control valve passages, in fluid communication, respectively, with said first, second, third, and fourth motor valve passages; and (c) said control valve means defining dampening passage means providing fluid communication between said fluid inlet means and said fluid outlet means when said control valve means is in a transition condition, between said first low speed, high torque condition and said second high speed, low torque condition.

7. A rotary fluid pressure device as claimed in claim 6, characterized by said control valve means comprising spool bore and a spool valve, said spool valve defining said dampening passage means, including a passage portion through which fluid flow is blocked by said spool bore when said control valve means is in either of said first low speed, high torque condition and said second high speed, low torque condition.

8. A rotary fluid pressure device as claimed in claim 7, characterized by means biasing said spool valve toward said first low speed, high torque condition of said control valve means, and said control valve means including a pilot chamber operable, in the presence of fluid pressure therein, to bias said spool valve toward said second high speed, low torque condition.

9. A rotary fluid pressure device as claimed in claim 8, characterized by said biasing means being selected such that a change in the force of said biasing means as said spool valve shifts is operable to overcome normal frictional forces within said control valve means, such that change in the position of said spool valve is substantially a function of a change in the fluid pressure in said pilot chamber.

* * * * *